US005887296A

United States Patent [19]

Handwerker

[11] Patent Number: 5,887,296

[45] Date of Patent: Mar. 30, 1999

[54] UNIVERSAL POOL COVER HAVING COMBINATION WATER DRAIN AND SAFETY PROPERTIES INTEGRAL THERETO

[75] Inventor: Gary Handwerker, Northfield, Ill.

[73] Assignee: Midwest Canvas Corp., Chicago, Ill.

[21] Appl. No.: 959,132

[22] Filed: Oct. 28, 1997

[51] Int. Cl.[6] ..... E04H 4/00

[52] U.S. Cl. ..... 4/498

[58] Field of Search ..... 4/498, 502

[56] References Cited

U.S. PATENT DOCUMENTS

| | | | |
|---|---|---|---|
| 2,580,555 | 1/1952 | Kroeger | 4/502 |
| 2,870,455 | 1/1959 | Reeves | 4/498 |
| 3,072,920 | 1/1963 | Yellott . | |
| 3,593,757 | 7/1971 | Haynes | 4/498 X |
| 3,982,286 | 9/1976 | Foster | 4/502 |
| 4,028,750 | 6/1977 | Gustafsson . | |
| 4,137,575 | 2/1979 | Klaffe et al. | 4/498 |
| 4,485,137 | 11/1984 | White . | |
| 4,709,688 | 12/1987 | Paradis . | |
| 5,549,956 | 8/1996 | Handwerker . | |
| 5,594,960 | 1/1997 | Stern | 4/498 |

*Primary Examiner*—Charles E. Phillips

[57] ABSTRACT

A universal, buoyant, lightweight, thermoplastic cover for a swimming pool and the like. The cover may be any color or shape and is adapted to continuously drain water that may otherwise accumulate on the exterior surface of the cover through an integral, longitudinally extending, woven mesh-like water drain apparatus. The drain apparatus may be centrally disposed, or otherwise suitably positioned on the cover, and laterally extends through the cover. A method to make the swimming pool cover is also disclosed.

11 Claims, 4 Drawing Sheets

UNIVERSAL POOL COVER HAVING COMBINATION WATER DRAIN AND SAFETY PROPERTIES INTEGRAL THERETO

FIELD OF THE INVENTION

This invention relates to universal, lightweight, swimming pool covers, and more particularly to a swimming pool cover constructed of a woven mesh-like thermoplastic layer having drain and safety properties integral thereto.

BACKGROUND OF THE INVENTION

Each year during the Fall and Winter seasons, inclement weather and the resulting lack of use and interest by swimming pool users results in most swimming pools being inactive for many months of the year. To protect the swimming pool from the inclement weather and other misadventures, most pools are covered with a heavy winter pool cover during this extended period of inactivity and not uncovered until warmer weather returns. If possible, pool repairs, maintenance, and improvements are scheduled during this regular period of inactivity, so the swimming pool cover must facilitate these events by being easy to install and remove. Similarly, during the Spring and Summer, for health and public safety reasons, the temporary covering of a swimming pool with a lighter pool cover is customary in many locales when the pool is left unsecured for other than a de minimis period of time. For example, many public swimming pools are closed each evening until the next morning, during which time the pool may be covered. It would be advantageous to have a universal swimming pool cover that is lightweight and easy to use, and which is capable of covering the pool for either an extended or temporary period of time without the need for separate swimming pool covers.

One drawback with most, if not all, existing swimming pool covers is that over time the cover will become permanently stretched out-of-shape. This is due to the weight associated with the accumulation of water at the center of the cover without the existence of an effective drain mechanism. Over time, such accumulation will exacerbate the sagging of the cover. As the pool cover continues to sag, it will be stretched out-of-shape, have general reduced effectiveness, and eventually have to be replaced by the owner. It would be advantageous to have a swimming pool cover that is lightweight and easy to use, yet not be stretched out-of-shape as a result of the common sagging problem of conventional covers.

Another shortcoming for some of the swimming pool covers contained in the prior art pertains to safety concerns. If a child were to fall onto a cover having drainage holes, the child could get his/her appendages caught in the holes and/or fall through them. Likewise, in the event a child should accidently get caught under the cover, in the ensuing struggle and resulting panic, the total weight of the cover would be significantly increased as a result of the captured water on the exterior surface, and it would be difficult for the child to physically overcome this weight. It would be advantageous to have a swimming pool cover with safe drainage holes and which does not accumulate water.

One prior art approach that is directed to these particular shortcomings, is a type of cover which has separate fine mesh-like cloth material sewn into the center of the cover to operate as a drain. However, this approach has not worked effectively as the cover is relatively heavy, the cloth mesh will clog and the cover continues to accumulate water in places other than where the drain is positioned, and, over time, will sag and be stretched out-of-shape.

Depending on the size and shape of the swimming pool to be covered, the initial out-of-pocket cost associated with various types of covers contained in the prior art is relatively high. It would be an advantage in the art if a lightweight, multi-layer swimming pool cover could be manufactured relatively inexpensively by utilizing thermoplastic films, be long-lasting, easy to maintain, and easy to clean.

The present invention overcomes the problems inherent in the prior art. The present invention combines a universal, lightweight swimming pool cover with an integral drain and safety mechanism which increases the effectiveness and safety of the cover when the cover is in place without significantly increasing the total weight or thickness of the swimming pool cover.

SUMMARY OF THE INVENTION

The principal object of the present invention is to provide a universal, lightweight swimming pool cover having an integral drain mechanism to allow water to pass through the cover to prevent the cover from stretching or sagging.

A further object of the present invention is to provide a swimming pool cover having a drain mechanism integral thereto, and which is also relatively inexpensive to manufacture, easy to use, durable and long-lasting.

In accordance with one embodiment of the invention, there is provided a universal, lightweight swimming pool cover having an integral drain mechanism to prevent stretching and sagging of the cover, comprising: a continuous layer of woven mesh-like thermoplastic material having a plurality of pores, said layer having an upper surface and a lower surface opposite thereof; and a moisture impervious sealant uniformly applied to said surfaces except to a centrally disposed water drain area of said layer, whereby the cover facilitates the draining of water from the upper surface through said pores of the drain area and into the pool.

These and other objects and advantages of the present invention will be clarified in the description of the preferred embodiment in connection with the attached drawings and the appended claims.

DESCRIPTION OF THE PREFERRED EMBODIMENT

Figure 1:
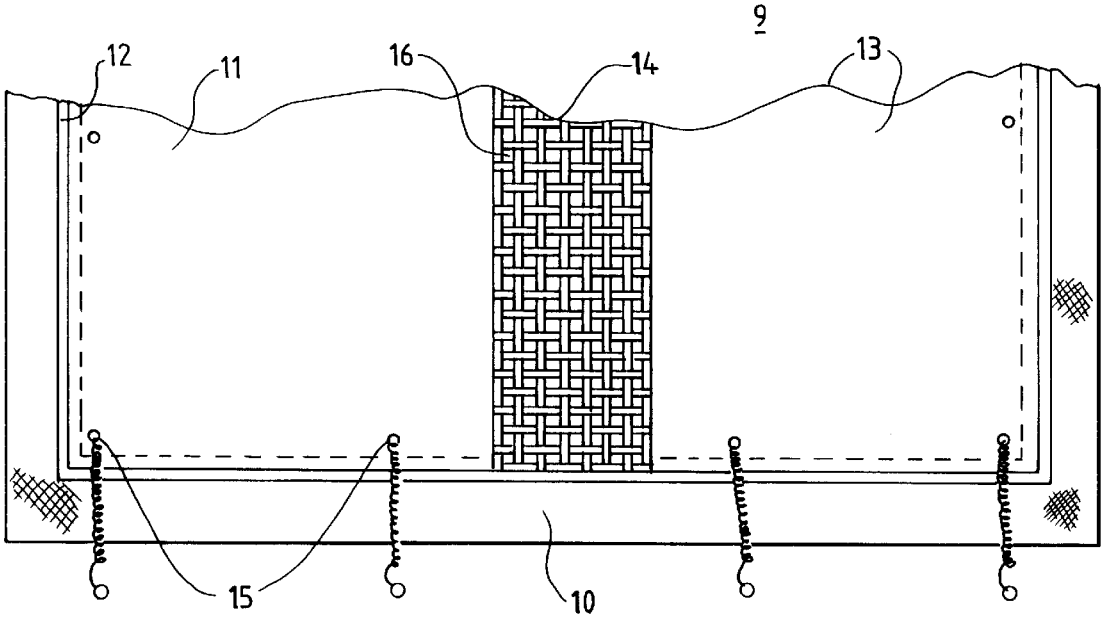
FIG. 1 is a partial top plan perspective view of a swimming pool cover of the present invention disposed on top of a swimming pool.

FIG. 1 illustrates swimming pool cover 9, disposed on top of a swimming pool 10, that is constructed in accordance with the present invention. In FIG. 1, depending on the exact size of the pool to be covered, cover 9 may be constructed in any shape and size including rectangular, square, circular, triangular, or any particular custom shape as required. The cover 9 is an all-weather cover that can be used in any season for either a temporary or extended period of time. The cover is mildew resistant and maintenance free, lightweight and buoyant (approximately less than six ounces per square yard), durable and long-lasting, pliable, and easy to clean. The cover 9 can easily be rolled-up or otherwise folded for easy handling and/or convenient storage. Under normal operating conditions, the cover 9 is reusable for many years. In the preferred embodiment, the cover 9 consists of high density woven polyethylene strips or fabric upper layer 11 and high density woven polyethylene strips or fabric lower layer 12. Layers 11, 12 are heat sealed together with a low-density polyethylene sealant 13 using conventional thermoplastic manufacturing practices that are well known to the industry, resulting in a single-piece cover that is air and water tight. As more fully explained below, sealant 13 is not applied to a generally central portion of layers 11, 12 to create drain area or mechanism 14. Alternatively, the cover may be constructed of only one layer of high density woven polyethylene which is then heat sealed with low-density polyethylene except at drain area 14. The cover 9 can be fabricated to have any particular color that is desired by the user, but preferably the cover will employ navy blue polyethylene to form layers 11, 12. Dark covers are preferred to absorb solar radiation and assist in melting any accumulated snow or ice on the cover.

The cover 9 can be finished along its peripheral edges 15 to facilitate the easy placement and removal of the cover from the swimming pool 10 using conventional, well understood methods. For example, the peripheral edges 15 may be hemmed, contain eyelets or be affixed to coupling hardware used to secure the cover to the edges of the pool, as illustrated.

The thermoplastic material used in forming the cover 9 can be selected from a wide variety of materials that are well known in the industry, including thermoplastic polymeric materials which are capable of forming heat-sealable films, but is preferably polyethylene. Layers 11, 12 are manufactured using conventional thermoplastic manufacturing practices for single-ply woven polyethylene films or fabrics. Particularly, the single-ply, mesh-like, woven polyethylene film used to produce layers 11, 12 is a high tensile HDPE woven film commercially available under the registered trademark LORETEX, manufactured by Loretex Corporation of Guilderland Center, New York 12085. Prior to heat sealing with sealant 13, the woven film consists of a somewhat loose-fitting mesh. Layers 11, 12 may be either opaque, transparent, translucent or a particular color depending on what has been selected during the manufacturing process. This woven polyethylene material is commonly referred to as 5 by 4 (e.g., 5 strands in the horizontal direction and 4 strands in the vertical per inch) but is available in various other weave patterns (e.g., 5 by 8, 7 by 10, 10 by 10, 12 by 12). The thickness of each single-ply film is approximately 1 mil.

Except for the drain apparatus 14, the layers 11, 12 are coated with a suitable thermoplastic sealant 13 which when dry will form a continuous moisture-impervious film, and which may be either opaque, transparent, translucent or a specific color. Following the heat sealing and continuous coating process, the layers 11, 12 have an associated thickness of approximately 3–5 mils.

To prevent cover 9 from sagging and stretching out-of-shape due to the common problem of the accumulation of water, the cover has an integral water drain area or mechanism 14. The water drain area 14 extends longitudinally approximately the entire length of the cover, at a more or less centralized location, although the drain 14 may be of a lesser length and continue to function effectively. Preferably, drain area 14 is 6 feet wide, although different widths may be utilized.

The drain area 14 operates in a manner that is equivalent to a matrix of rows and columns of loose-fitting polyethylene film having any specified width and any specified length resulting in generally square or rectangular-shaped pores or apertures 16 which extend through the cover 9. In the preferred embodiment, each of the pores 16 are approximately ⅛ inch by ⅛ inch in width and length, although the exact size of the pores may vary depending on the particular size of the woven polyethylene film or fabric that is selected for the manufacturing process.

Although cover 9 is not designed to be walked upon while positioned securely over the pool, the cover and drain area are generally capable of withstanding the weight of a small child if the child accidentally fell onto the cover.

Figure 2:
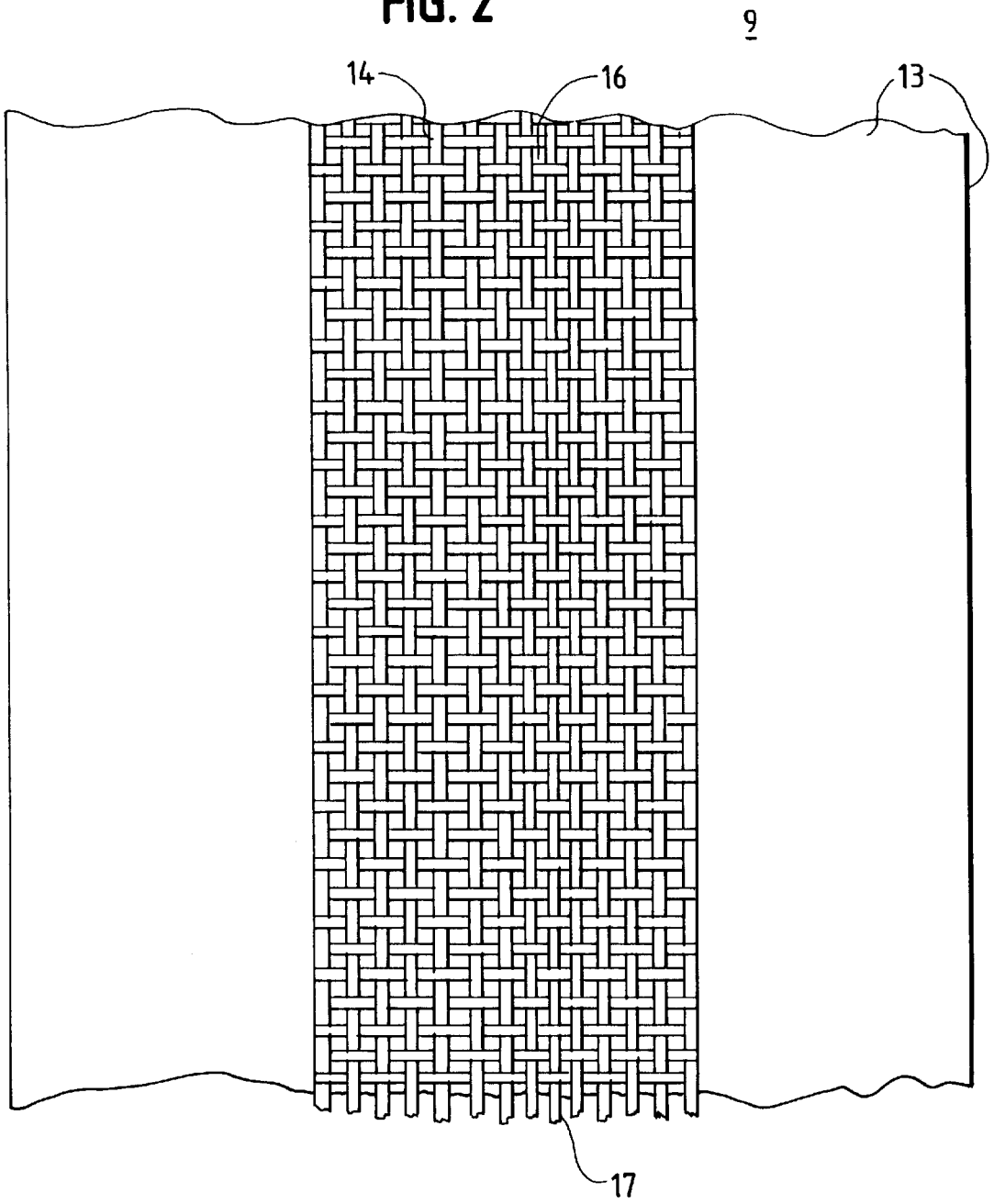
FIG. 2 is a fragmentary top plan view of the swimming pool cover of FIG. 1, showing a partial top view of the woven mesh-like mesh drain apparatus.
Figure 3A:
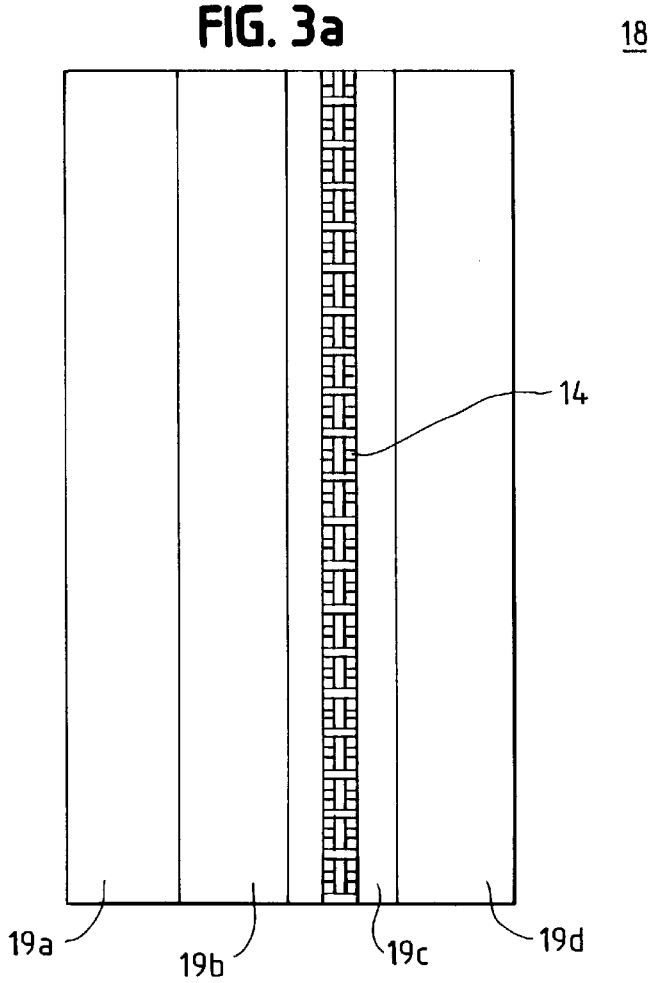
FIG. 3A is a top plan view of the pool cover of the present invention having a rectangular construction.

FIG. 2 is a fragmentary perspective view of the swimming pool cover 9 of FIG. 1, showing a partial top plan view of the woven mesh-like drain mechanism 14, with a loose tag end 17 illustratively unraveled, that is constructed in accordance with the present invention. In FIG. 2, the tag end 17 depicts the continuous weave that exists throughout the entire cover, irrespective of whether the particular portion of the cover is coated with polyethylene sealant 13. In FIG. 3A, the cover 18 has a rectangular shape (for example, 40 feet in length and 24 feet in width). The drain area 14 associated with the cover 18 is positioned slightly offset from the center of the cover. The cover 18 can be fabricated in any specified length and width. For the preferred embodiment, it was determined that the cover 18 can be manufactured in four sections having widths of six feet with lengths of 40 feet. Thereafter, in a secondary finishing operation, the strips 19*a*, 19*b*, 19*c*, 19*d* are hot glued and then sewn or affixed together using conventional methods to achieve the 24 foot width requirement that is depicted for the rectangular cover 18 in FIG. 3A.

Figure 3B:
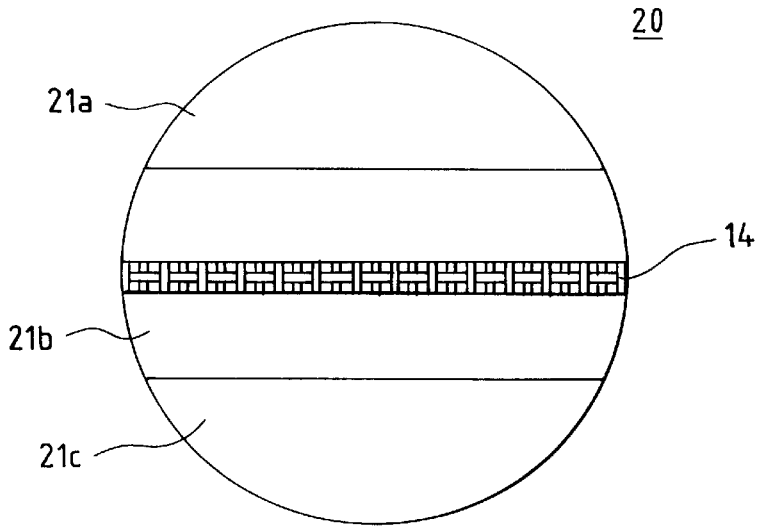
FIG. 3B is a top plan view of the pool cover of the present invention having a circular construction.

In FIG. 3B, the cover has a circular shape having, for example, a diameter of 18 feet. The drain area 14 associated with the cover 20 is positioned approximately in the center of the cover. The cover 20 is constructed in the same manner as cover 9 and can be fabricated to fulfill any size requirement directed to any specified diameter. For the preferred embodiment, it was determined that the cover 20 can be manufactured in sections of six feet widths and an indefinite length, but preferably 18 feet. Thereafter, in a secondary finishing operation, the strips 21*a*, 21*b*, 21*c* are hot glued and then sewn or affixed together using conventional methods to achieve the 18 foot width requirement of the diameter for the circular cover 20.

Figure 4:
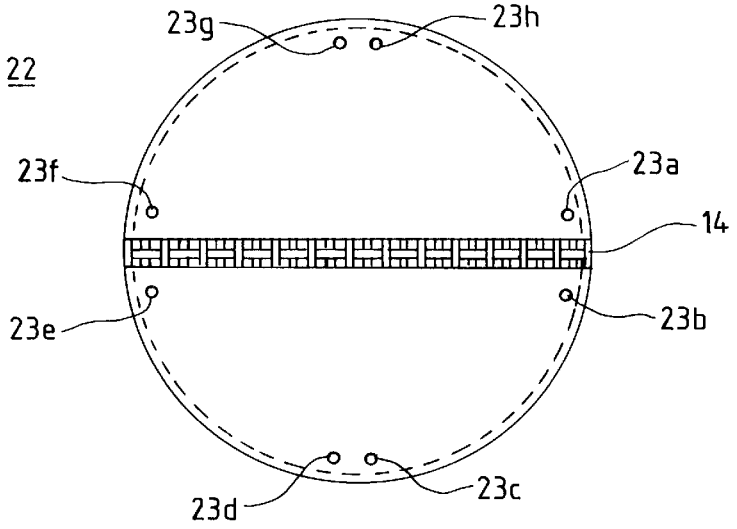
FIG. 4 is a top plan view of a further embodiment of the pool cover of the present invention.

In FIG. 4, the cover 22 is circular having, for example, a diameter of 4 feet and can be used for small pools, hot tubs, and the like. The cover 22 is fabricated in the identical manner to the cover 9 discussed previously, with the associated drain apparatus 14 positioned generally in the center of the cover. The drain apparatus 14 is secured to the cover by sewn hems.

To facilitate the solar heating of the water, the cover 22 is a dark navy blue color. The cover is hemmed about its periphery using conventional sewing methods forming a double-strength stronger support area where pairs of eyelets 23*a–b*, 23*c–d*, 23*e–f*, 23*g–h* are inserted to facilitate positioning the cover on the pool or hot tub.

Figure 5:
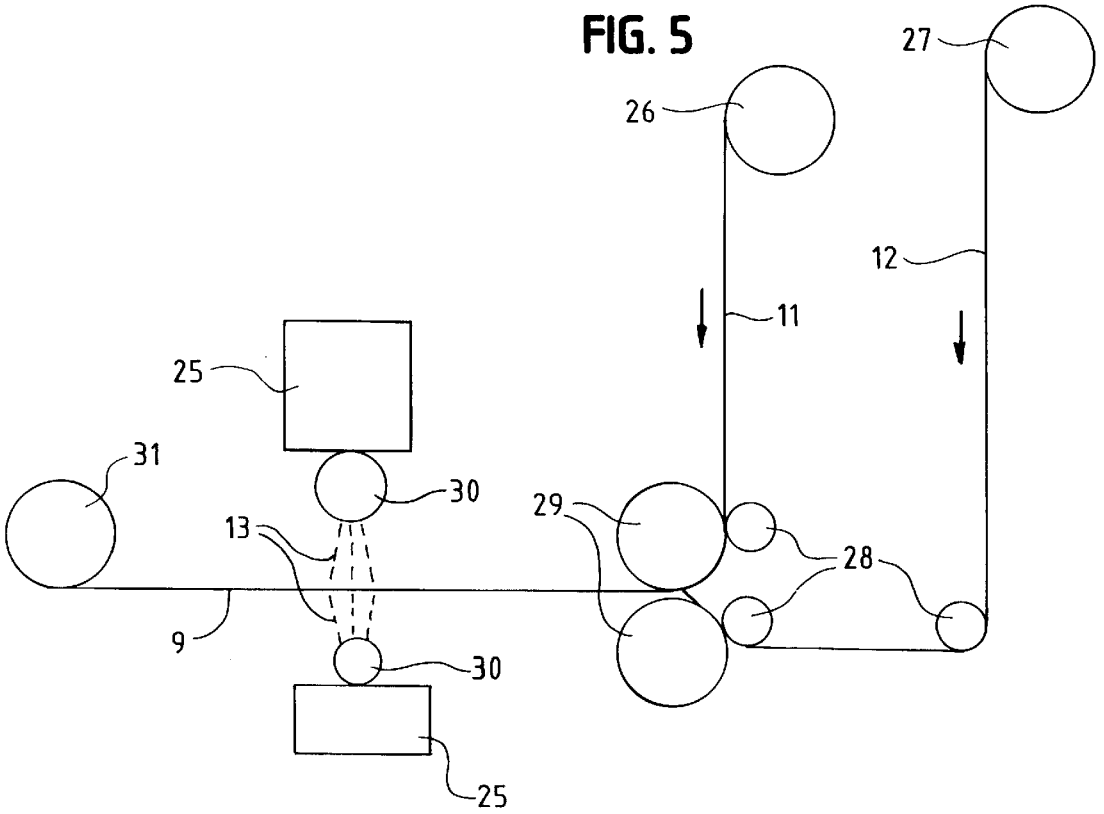
FIG. 5 is a schematic elevational view of the manufacturing process for the pool cover of the present invention.

Referring to FIGS. 1 and 5, the water drain area 14 is constructed by selectively stopping the in line polyethylene heat sealing extrusion or gluing die or apparatus 25 such that layers 11 and 12 are unsealed where the drain mechanism 14 is to be located. Such selective stopping can be accomplished with blocking means such as the physical plugging of the appropriate slots or openings associated with the hot sealing apparatus 25 to prohibit the sealing of layers 11, 12 where the plug is affixed to the die. This method is referred to as in line strip coating. Alternatively, a custom hot-melt extrusion die (not shown) can be manufactured for a particular size of cover utilizing blocking means for retaining drain area 14 generally in the center of the cover.

As illustrated in FIG. 5, rolls 26, 27 of layers or webs 11, 12 are brought together and registered using small and large rollers 28 and 29. Rolls 26, 27 may be of any suitable width. As webs 11, 12 move in the direction illustrated, they are heat sealed with molten sealant 13 as they pass through the heat sealing apparatus 25. Blocking means 30 is employed to prevent the sealing of drain area 14 by strip coating. Once the molten sealant 13 cools and dries, the web of layers 11, 12 and sealant 13 is stored on roll 31 and thereafter is finished into cover 9 using conventional methods.

Although the foregoing detailed description of the present invention has been described by reference to several embodiments, and the best mode contemplated for carrying out the present invention has been herein shown and described, it will be understood that modifications or variations in the structure and arrangement of these embodiments may be achieved by those skilled in the art and that such modifications are to be considered as being within the overall scope of the present invention.

I claim:

1. A universal, lightweight swimming pool cover having an integral drain mechanism to prevent stretching and sagging of the cover due to accumulated water, comprising:

a layer of woven mesh-like thermoplastic material having a plurality of pores in a predetermined pattern, said layer having a first surface and a second surface opposite thereof; and a moisture impervious sealant uniformly applied to selected portions of said surfaces closing said pores in said selected portions, said sealant avoiding a water drain portion of said layer, said drain portion comprising open pores disposed generally in the center of said cover, the cover facilitating the draining of water from the first surface through the water drain portion and past the second surface.

2. The cover of claim 1 wherein said thermoplastic material comprises polyethylene.

3. The cover of claim 1 wherein said layer is comprised of high density woven polyethylene fabric.

4. The cover of claim 3 wherein said sealant is low density polyethylene.

5. The cover of claim 1 wherein said pores are approximately ⅛ inch by ⅛ inch in width and length.

6. The cover of claim 1 wherein said water drain area extends the length of the cover.

7. A universal, lightweight swimming pool cover having an integral drain mechanism to prevent stretching and sagging of the cover due to accumulated water, comprising:

a layer of a loose-fitting matrix of high density polyethylene strips having a vertical and horizontal weave pattern and having a plurality of pores between said strips, said layer having a first surface and a second surface opposite thereof; and a low density polyethylene sealant uniformly applied to selected portions of said surfaces closing said pores in said selected portions, said sealant avoiding a water drain portion of said layer, said drain portion comprising open pores disposed generally in the center of said cover and extending the length of said cover, the cover facilitating the draining of water from the first surface through said pores of the water drain portion.

8. The cover of claim 7 wherein said strips have a thickness of approximately 1 mil. and said pores are approximately ⅛ inch by ⅛ inch in width and length.

9. The cover of claim 7 wherein said layer has a thickness of approximately 3–5 mils. after said sealant has been applied to said surfaces.

10. A universal, lightweight swimming pool cover having an integral drain mechanism to prevent stretching and sagging of the cover due to accumulated water, comprising;

an upper layer of woven mesh-like thermoplastic material having a plurality of pores in a predetermined pattern;

a lower layer of woven mesh-like thermoplastic material having a plurality of pores in a predetermined pattern; and a moisture impervious sealant uniformly applied to said layers except to a water drain portion of said layers, said drain portion being located generally in the center of said cover, the cover facilitating the draining of water from a top surface of the drain area through said pores of said water drain portion.

11. The cover of claim 10 wherein said layers comprise loose-fitting matrices of high density polyethylene strips having vertical and horizontal weave patterns, and said sealant comprises low density polyethylene.

* * * * *